US011282637B2

(12) United States Patent
Koo et al.

(10) Patent No.: US 11,282,637 B2
(45) Date of Patent: Mar. 22, 2022

(54) INDUCTOR

(71) Applicant: SAMSUNG ELECTRO-MECHANICS CO., LTD., Suwon-si (KR)

(72) Inventors: Gun Woo Koo, Suwon-si (KR); Sung Min Song, Suwon-si (KR); Hwan Soo Lee, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 462 days.

(21) Appl. No.: 16/356,295

(22) Filed: Mar. 18, 2019

(65) Prior Publication Data

US 2020/0066439 A1 Feb. 27, 2020

(30) Foreign Application Priority Data

Aug. 22, 2018 (KR) ..... 10-2018-0097858

(51) Int. Cl.
*H01F 5/00* (2006.01)
*H01F 27/36* (2006.01)
(Continued)

(52) U.S. Cl.
CPC ..... *H01F 27/36* (2013.01); *H01F 27/28* (2013.01); *H01F 27/29* (2013.01); *H01F 27/327* (2013.01)

(58) Field of Classification Search
USPC ..... 336/200
See application file for complete search history.

(56) References Cited

U.S. PATENT DOCUMENTS

2015/0102891 A1* 4/2015 Yoon ..... H01F 27/2804 336/200
2016/0126918 A1 5/2016 Ahn et al.
(Continued)

FOREIGN PATENT DOCUMENTS

CN 108183017 A 6/2018
CN 108335829 A 7/2018
(Continued)

OTHER PUBLICATIONS

Korean Office Action dated Oct. 10, 2019 issued in Korean Patent Application No. 10-2018-0097858 (with English translation).
(Continued)

*Primary Examiner* — Ronald Hinson
(74) *Attorney, Agent, or Firm* — Morgan, Lewis & Bockius LLP

(57) ABSTRACT

An inductor includes a body including a substrate, a coil portion, including a top coil and a bottom coil disposed on one surface and the other surface of the substrate, respectively, and an encapsulation portion encapsulating the substrate and the coil portion, a first terminal electrode, disposed on a bottom surface of the body and connected to the top coil, and a second terminal electrode disposed on the bottom surface of the body and connected to the bottom coil, a third terminal electrode disposed between the first and second terminal electrodes and disposed on the bottom surface of the body, and a shielding layer disposed to cover the body. The shielding layer is connected to the third terminal electrode.

18 Claims, 3 Drawing Sheets

(51) Int. Cl.

| | |
|---|---|
| ***H01F 27/32*** | (2006.01) |
| ***H01F 27/29*** | (2006.01) |
| ***H01F 27/28*** | (2006.01) |

(56) References Cited

U.S. PATENT DOCUMENTS

| | | | | |
|---|---|---|---|---|
| 2016/0217920 | A1 | 7/2016 | Choi et al. | |
| 2017/0110240 | A1 | 4/2017 | Masuda et al. | |
| 2017/0200682 | A1* | 7/2017 | Lin | H01L 24/97 |
| 2018/0096783 | A1* | 4/2018 | Fukuda | H01F 27/346 |
| 2018/0158783 | A1 | 6/2018 | Lin et al. | |
| 2018/0166211 | A1* | 6/2018 | Takatsuji | H02M 3/156 |
| 2018/0204663 | A1 | 7/2018 | Lee et al. | |
| 2019/0318868 | A1* | 10/2019 | Chung | H05K 9/0018 |

FOREIGN PATENT DOCUMENTS

| | | | |
|---|---|---|---|
| JP | 2017-076796 | A | 4/2017 |
| KR | 10-2015-0044372 | A | 4/2015 |
| KR | 10-2016-0052111 | A | 5/2016 |
| KR | 10-1642612 | B1 | 7/2016 |
| KR | 10-2016-0092543 | A | 8/2016 |

OTHER PUBLICATIONS

Chinese Office Action dated Jan. 25, 2022 issued in Chinese Patent Application No. 201910559482.7 (with English translation).

* cited by examiner

INDUCTOR

CROSS-REFERENCE TO RELATED APPLICATION(S)

This application claims the benefit of priority to Korean Patent Application No. 10-2018-0097858 filed on Aug. 22, 2018 in the Korean Intellectual Property Office, the disclosure of which is incorporated herein by reference in its entirety.

TECHNICAL FIELD

The present disclosure relates to an inductor, and more particularly, to a power inductor having an electromagnetic interference (EMI) noise shielding function.

BACKGROUND

An issue of electromagnetic interference (EMI) has been discussed, due to various electromagnetic waves generated in electronic components. Such EMI noise is an unnecessary signal, which may weaken circuit functions and cause malfunctioning, and becomes more problematic with improvements in the performance of semiconductor chips.

SUMMARY

An aspect of the present disclosure is to provide an inductor having an improved EMI shielding function.

According to an aspect of the present disclosure, an inductor includes a body including a substrate, a coil portion, including a top coil and a bottom coil disposed on one surface and the other surface of the substrate, respectively, and an encapsulation portion encapsulating the substrate and the coil portion, a first terminal electrode, disposed on a bottom surface of the body and connected to the top coil, and a second terminal electrode disposed on the bottom surface of the body and connected to the bottom coil, a third terminal electrode disposed between the first and second terminal electrodes and disposed on the bottom surface of the body, and a shielding layer disposed to cover the body. The shielding layer is connected to the third terminal electrode.

The body further may include an insulating layer covering the encapsulation portion.

The inductor may further include an external insulating layer disposed to cover the shielding layer.

The shielding layer may include at least one of carbon (C), aluminum (Al), iron (Fe), nickel (Ni), and chromium (Cr).

The top and bottom coils may be connected by a via.

The via may penetrate one surface of the substrate from the other surface of the substrate.

The substrate may be disposed perpendicularly to the bottom surface of the body.

The body may have the bottom surface and a top surface disposed to oppose the bottom surface, and the bottom and top surfaces of the body may be disposed to oppose each other in a thickness direction of the body.

The body may further have a first side surface and a second side surface, disposed to oppose each other in a width direction, perpendicular to the thickness direction, and a first end surface and a second end surface disposed to oppose each other in a length direction perpendicular to the thickness direction and the width direction.

The first and second terminal electrodes may be spaced apart from each other in the length direction.

Lengths of the first and second terminal electrodes extending in the width direction may be equal to each other.

A length of each of the first and second terminal electrodes extending in the width direction may be less than a length of the third terminal electrode extending in the width direction.

An external insulating layer may further be disposed on the shielding layer to cover the shielding layer.

The external insulating layer may include the same material as the insulating layer included in the body.

The shielding layer and the first and second terminal electrodes may be spaced apart from each other.

Each of the top and bottom coils may have a spiral shape.

The shielding layer may completely cover the body except the bottom surface.

The third terminal electrode may extend between portions of the shielding layer respectively disposed on a first side surface and a second side surface of the body opposing each other in a width direction of the body.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
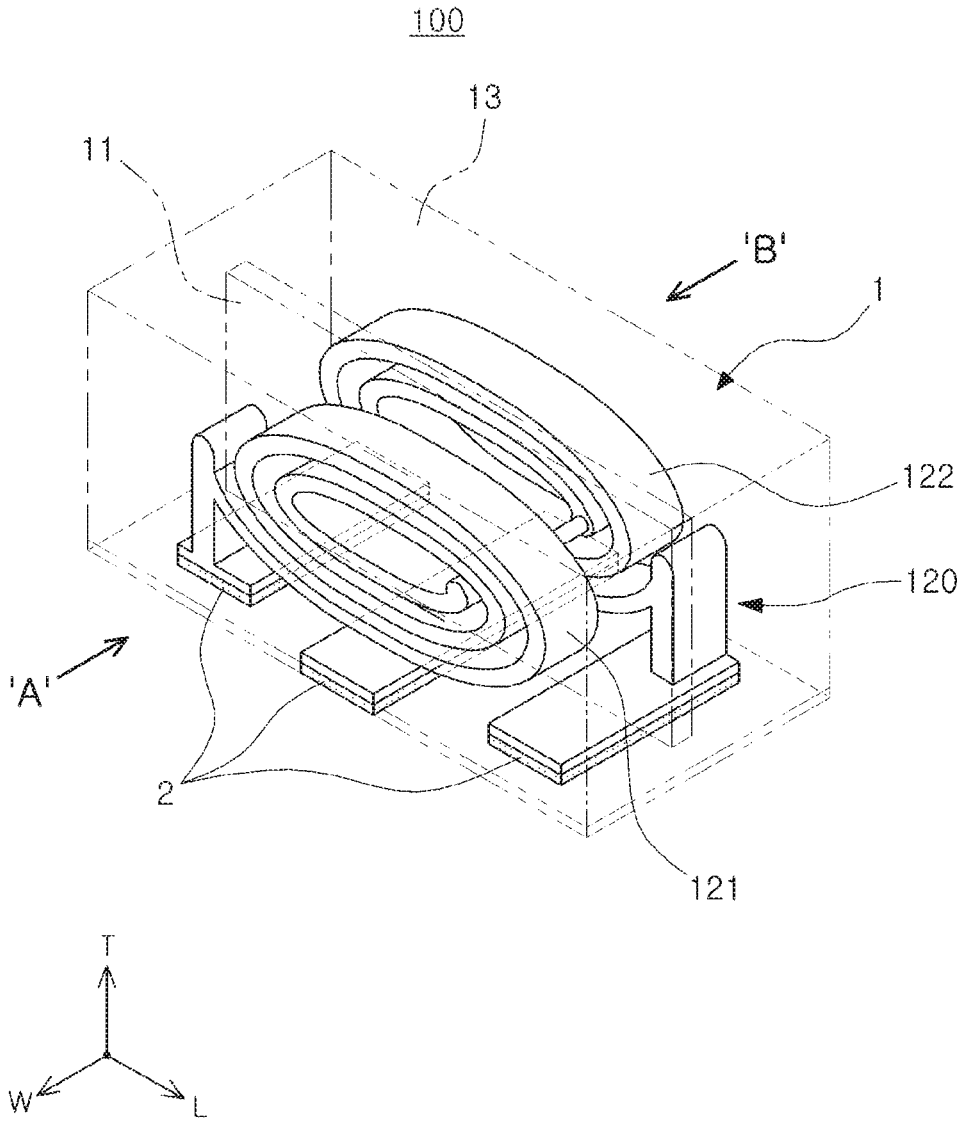
FIG. 1 is a perspective view of an inductor according to an exemplary embodiment in the present disclosure.

Hereinafter, examples of the present disclosure will be described as follows with reference to the attached drawings.

The present disclosure may, however, be embodied in many different forms and should not be construed as limited to the examples set forth herein. Rather, these examples are provided so that this disclosure will be thorough and complete, and will fully convey the scope of the present disclosure to those skilled in the art.

The same reference numerals are used to designate the same elements throughout the drawings. In the drawings, the sizes and relative sizes of layers and regions may be exaggerated for clarity.

Hereinafter, an inductor according to an exemplary embodiment in the present disclosure will be described, but is not necessarily limited thereto.

Figure 2:
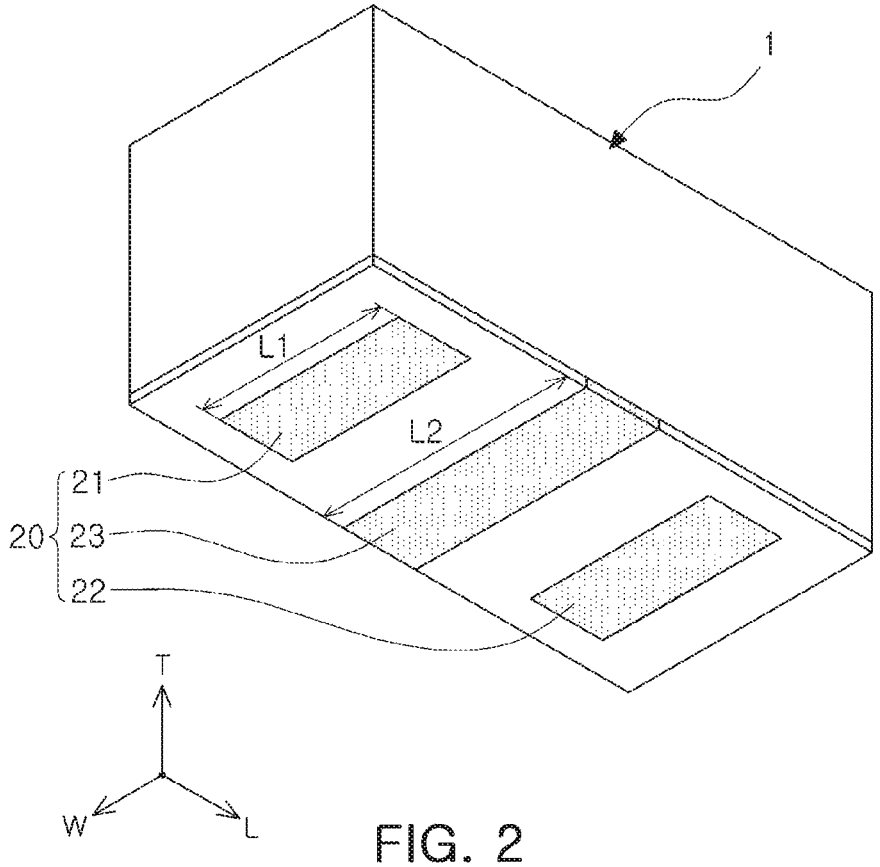
FIG. 2 is a bottom view of the inductor in FIG. 1.
Figure 3:
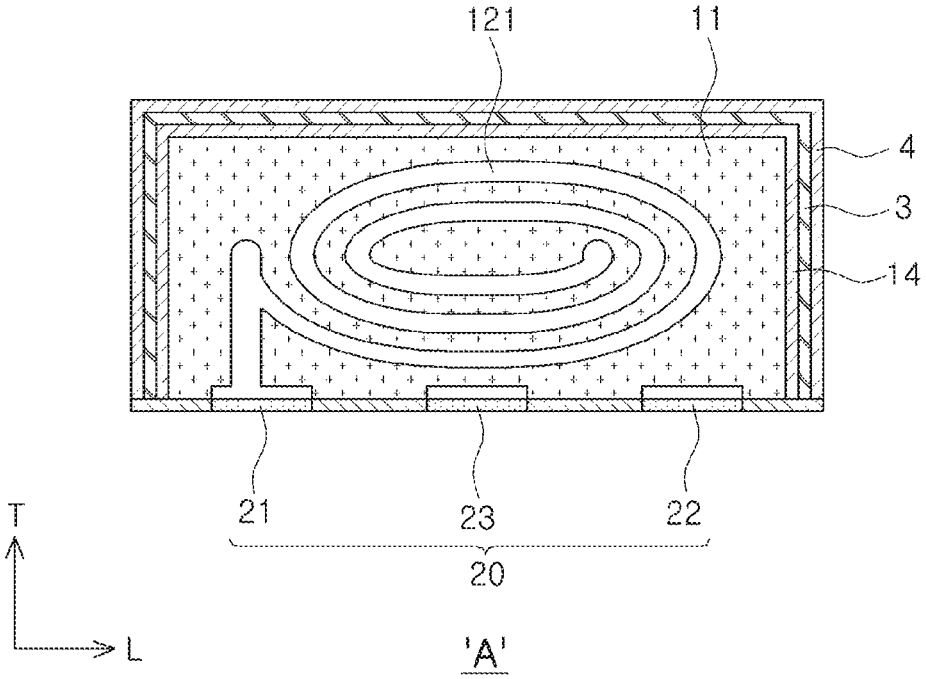
FIG. 3 is a cross-sectional view taken in direction A in FIG. 1.
Figure 4:
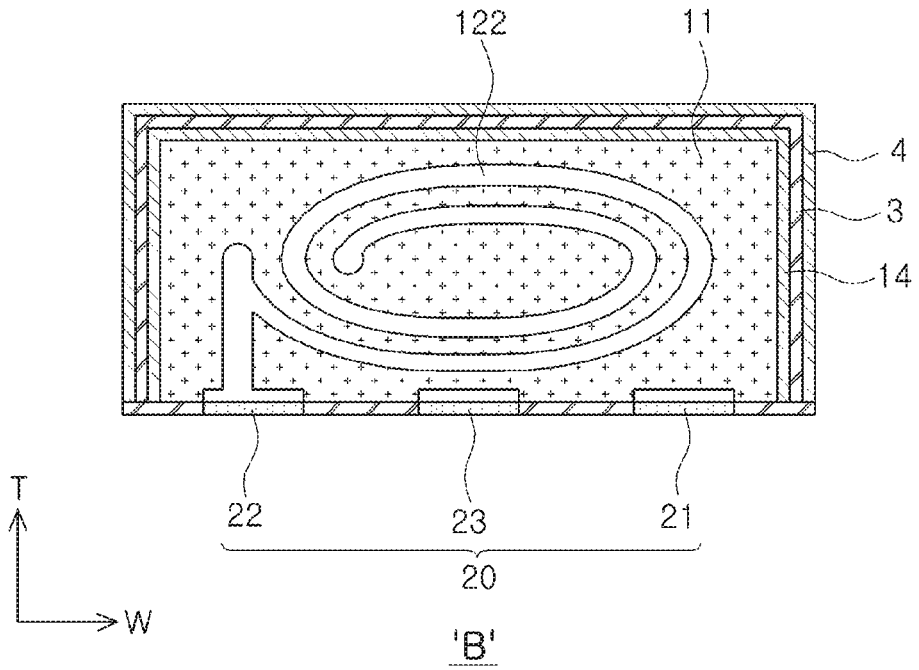
FIG. 4 is a cross-sectional view taken in direction B in FIG. 1.
Figure 5:
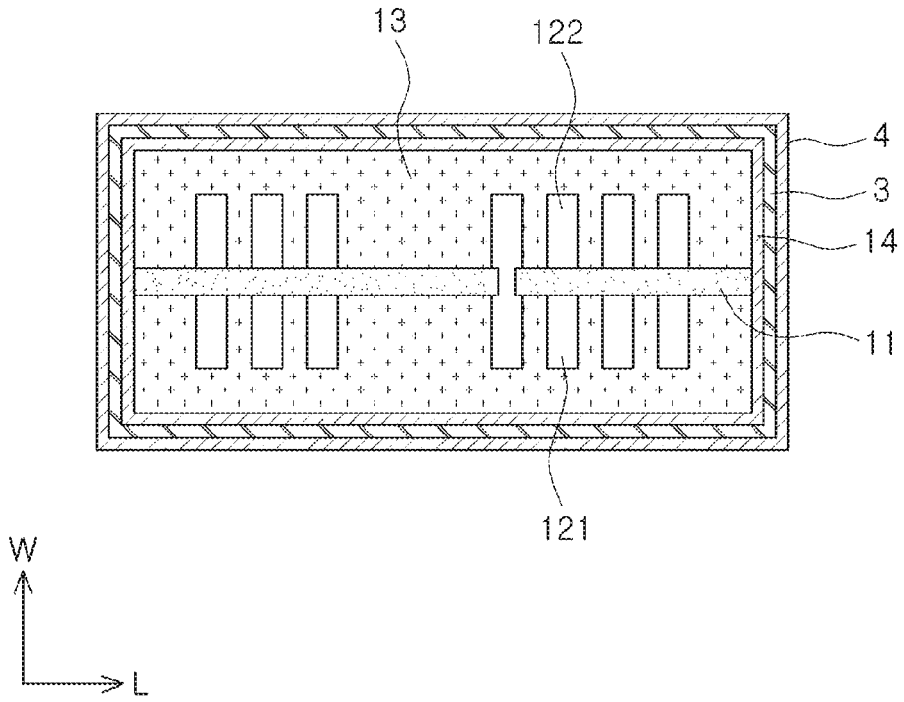
FIG. 5 is a cross-sectional view from above in FIG. 1.

FIG. 1 is a perspective view of an inductor according to an exemplary embodiment in the present disclosure. FIG. 2 is a bottom view of the inductor in FIG. 1, FIG. 3 is a cross-sectional view taken in direction A in FIG. 1, FIG. 4 is a cross-sectional view taken in direction B in FIG. 1, and FIG. 5 is a cross-sectional view from above in FIG. 1.

Referring to FIG. 1, an inductor 100 includes a body 1 and terminal electrodes 2.

The body 1 has a substantially hexahedral shape having a first side surface and a second side surface disposed to oppose each other in a width direction W of the body 1, a first end surface and a second end surface disposed to oppose each other in a length direction L of the body 1, and a top surface and a bottom surface disposed to oppose each other in a thickness direction T of the body 1.

The inside of the body 1 includes a substrate 11, a coil portion 120, including top and bottom coils 121 and 122 disposed on one surface and the other surface of the substrate 11, and an encapsulation portion 13, including magnetic powder particles, configured to encapsulate the coil portion 120.

The substrate 11 is provided to make the top and bottom coils 121 and 122 thinner, and a material of the substrate 11 may be applied without limitation as long as the material has insulating properties. For example, the substrate 11 may be a thermosetting resin such as an epoxy resin, a thermoplastic resin such as polyimide, or a resin impregnated with a reinforcing material such as glass fiber or inorganic filler such as prepreg, ABF, FR-4, a bismaleimide triazine (BT) resin, a photoimageable dielectric (PID) resin, or the like. In this case, if the glass fiber is included in the substrate 11, the rigidity may be further improved.

The substrate 11 has a via hole connecting the top and bottom coils 121 and 122 to each other, and the via hole is filled with a material, having electrical conductivity, to electrically connect the top and bottom coils 121 and 122 to each other.

The substrate 11 is disposed perpendicularly to top and bottom surfaces of the body 1.

Although the cross-sectional shape of the substrate 11 is shown as a rectangle in FIG. 1, the shape is merely an example, and those skilled in the art will understand that an external portion or a central portion of the substrate 11 may be removed through laser processing or the like in such a manner that an external shape of the substrate 11 is the same as an external shape of the coil portion 120 disposed thereon. In this case, a space, in which a magnetic material is filled, may be enlarged to increase permeability of the inductor.

A top coil 121 is disposed on one surface of the substrate 11, and a bottom coil 122 is disposed on the other surface disposed to oppose the one surface of the substrate 11. Each of the upper and lower coils 121 and 122 has a spiral shape.

Referring to FIGS. 3 and 4, the top coil 121 is connected to a first terminal electrode 21 disposed on a bottom surface of the body 1, and the bottom coil 122 is connected to a second terminal electrode 22 disposed on the bottom surface of the body 1.

The first and second terminal electrodes 21 and 22 are disposed on the bottom surface of the body 1 to constitute a bottom electrode.

The first and second terminal electrodes 21 and 22 are disposed to on the bottom surface of the body 1 be spaced apart from each other in a length direction of the body 1.

A third terminal electrode 23 is disposed between the first and second terminal electrodes 21 and 22.

Each of the first, second, and third terminal electrodes 21, 22, and 23 may include a metal having improved electrical conductivity, in detail, nickel (Ni), tin (Sn), gold (Au), or the like, and may have a single-layer structure or a multilayer structure as required by those skilled in the art. The first to third terminal electrodes 21, 22, and 23 may include the same material and may have the same lamination structure. However, the material and the structure thereof are not limited thereto. The first and second terminal electrodes 21 and 22 may be implemented with a plurality of layers, while the third terminal electrode 23 may be implemented with a single layer.

Referring to FIG. 2, lengths L1 of the first and second terminal electrodes 21 and 22 extending in a width direction of the body 1 are substantially equal to each other and are less than a length L2 of the third terminal electrode 23 extending in the width direction of the body 1.

Unlike the first and second terminal electrodes 21 and 22 connected to the top and bottom coils, the third terminal electrode is connected to a shielding layer 3 covering an external surface of the body 1. The external surface of the body 1 covered with the shielding layer 3 is substantially an insulating layer 14. The insulating layer 14 serves to entirely insulate the encapsulation portion 13 in the body 1.

The shielding layer 3 serves to shield EMI noise. A detailed material of the shielding layer 3 may be appropriately selected by those skilled in the art. However, the shielding layer 3 may include at least one of carbon (C), aluminum (Al), iron (Fe), nickel (Ni), chromium (Cr), and combinations thereof.

The shielding layer 3 may be formed to cover the entire body except the surface on which terminal electrodes 20 including the first to third terminal electrodes 21 to 23 are formed, such that the shielding layer 3 may appropriately perform a shielding function. A representative method of forming the shielding layer may be one of plating, ion plating, spray coating, vacuum deposition, and sputtering.

In addition, an external insulating layer 4 is further disposed on the shielding layer 3. The external insulating layer 4 may be formed of substantially the same material as the insulating layer 14, but a material of the external insulating layer 4 is not limited thereto. In detail, the external insulating layer 4 may be formed of a material different from a material of the insulating layer 14.

The external insulating layer 4 and the insulating layer 14 may include at least one of $SiO_2$, epoxy, and perylene. A manner of coating an insulating resin or the like may be applied, but is not limited thereto.

The shielding layer 3 is applied to five surfaces except for the bottom surface of the body 1 to be directly connected to the third terminal electrode 23 disposed on the bottom surface of the body 1 and to be tightly sealed, allowing the shielding function to be further enhanced. Since the third terminal electrode 23 serves as a ground electrode, EMI noise of the shielding layer 3 may be emitted through the ground electrode.

Although the shielding layer 3 is represented by a single layer in FIGS. 3 to 5, it is a matter of course that the shielding layer 3 may include a plurality of shielding layers to completely prevent electromagnetic waves from being transmitted outwardly of the inductor 100.

Referring to FIG. 5, it can be seen that a plating growth direction of the top and bottom coils 121 and 122 is the width direction W of the body. As a result, the sum of the thicknesses of the top and bottom coils 121 and 122 is determined in consideration of a length of the body 1 in the width direction W. In this case, even when the length of the inductor 100 in width direction W is insufficient, capacitance of a coil may be increased by sufficiently increasing the number of windings of the coil, which is advantageous in designing an ultra-small, high-capacitance inductor.

Since the inductor 100 includes three terminals including the first to third terminal electrodes 21, 22, and 23, the inductor 100 may be mounted in the same manner as a related-art three-terminal product. Thus, the inductor 100 may be applied to an existing application, for example, a converter application such as an application processor (AP), a charger, a display, or the like.

Also, since a coil is formed in a direction perpendicular to the bottom surface thereof, the inductor 100 is advantageously used as a low-profile ultra-slim inductor having a limitation in a thickness of a body.

As described above, an inductor according to an exemplary embodiment may be equivalently applied to an existing application and has an improved EMI shielding function.

While exemplary embodiments have been shown and described above, it will be apparent to those skilled in the art that modifications and variations could be made without departing from the scope of the present invention as defined by the appended claims.

What is claimed is:

1. An inductor comprising:

a body including a substrate, a coil portion, including a top coil and a bottom coil disposed on one surface and the other surface of the substrate, respectively, and an encapsulation portion encapsulating the substrate and the coil portion;

a first terminal electrode, disposed on a bottom surface of the body and connected to the top coil, and a second terminal electrode disposed on the bottom surface of the body and connected to the bottom coil;

a third terminal electrode disposed between the first and second terminal electrodes, and extending continuously between edges of the bottom surface of the body in a width direction of the body; and a shielding layer disposed to cover the body, wherein the shielding layer is connected to the third terminal electrode, and each of the first terminal electrode and the second terminal electrode is spaced apart from the edges of the bottom surface of the body in the width direction of the body.

2. The inductor of claim 1, wherein the shielding layer includes at least one of carbon (C), aluminum (Al), iron (Fe), nickel (Ni), and chromium (Cr).

3. The inductor of claim 1, wherein the substrate is disposed perpendicularly to the bottom surface of the body.

4. The inductor of claim 1, wherein the shielding layer and the first and second terminal electrodes are spaced apart from each other.

5. The inductor of claim 1, wherein each of the top and bottom coils has a spiral shape.

6. The inductor of claim 1, wherein the shielding layer completely covers the body except the bottom surface.

7. The inductor of claim 1, wherein the third terminal electrode extends between portions of the shielding layer respectively disposed on surfaces of the body opposing each other in the width direction of the body.

8. The inductor of claim 1, wherein the body further includes an insulating layer covering the encapsulation portion.

9. The inductor of claim 8, wherein the insulating layer is made one of $SiO_2$, epoxy, or perylene.

10. The inductor of claim 1, wherein the top and bottom coils are connected by a via.

11. The inductor of claim 10, wherein the via penetrates one surface of the substrate from the other surface of the substrate.

12. The inductor of claim 1, wherein the body has the bottom surface and a top surface disposed to oppose the bottom surface, and the bottom and top surfaces of the body are disposed to oppose each other in a thickness direction of the body.

13. The inductor of claim 12, wherein the body further has a first side surface and a second side surface, disposed to oppose each other in the width direction, and a first end surface and a second end surface disposed to oppose each other in a length direction of the body.

14. The inductor of claim 13, wherein the first and second terminal electrodes are spaced apart from each other in the length direction.

15. The inductor of claim 13, wherein lengths of the first and second terminal electrodes extending in the width direction are equal to each other.

16. The inductor of claim 1, further comprising an external insulating layer disposed on the shielding layer to cover the shielding layer.

17. The inductor of claim 16, wherein the external insulating layer includes the same material as the insulating layer included in the body.

18. The inductor of claim 16, wherein the external insulating layer is made one of $SiO_2$, epoxy, or perylene.

* * * * *